United States Patent [19]

Undin et al.

[11] Patent Number: 4,981,451

[45] Date of Patent: Jan. 1, 1991

[54] METHOD OF PRODUCING CONTACT ELEMENTS FROM BAND MATERIAL AND CONTACT ELEMENTS PRODUCED BY THE METHOD

[75] Inventors: Hans Undin, Akersberga, Sweden; Bernhard Boche, Detmold, Fed. Rep. of Germany; Bernd David, Detmold, Fed. Rep. of Germany; Ulrich Wiebe, Dörentrup, Fed. Rep. of Germany

[73] Assignee: C.A. Weidmuller GmbH & Co., Fed. Rep. of Germany

[21] Appl. No.: 386,451

[22] Filed: Jul. 28, 1989

[30] Foreign Application Priority Data

Aug. 1, 1988 [SE] Sweden ..... 8802775
Apr. 7, 1989 [SE] Sweden ..... 8901230

[51] Int. Cl.[5] ..... H01R 4/70; H01R 4/18

[52] U.S. Cl. ..... 439/885; 439/936; 29/884

[58] Field of Search ..... 439/936, 397, 885, 932, 439/933, 886, 877, 879; 29/884, 885, 876–878

[56] References Cited

U.S. PATENT DOCUMENTS

| | | | |
|---|---|---|---|
| 2,443,513 | 6/1948 | Quackenbush | 439/936 |
| 2,758,947 | 8/1956 | Freighner | 439/936 |
| 2,786,191 | 3/1957 | Broske | 439/937 |
| 2,845,606 | 7/1958 | Fuller | 439/937 |
| 3,386,072 | 5/1968 | Chandler | 439/936 |
| 3,715,456 | 2/1973 | Faulkner | 439/877 |
| 4,464,541 | 8/1984 | Ceresa et al. | 29/877 |

OTHER PUBLICATIONS

German Standard DIN 46228, Part 2, Aug., 1987.

*Primary Examiner*—Gary F. Paumen
*Attorney, Agent, or Firm*—Cushman, Darby & Cushman

[57] ABSTRACT

A contact element such as an end-sleeve or a cable shoe, having a connecting portion and a contact portion, is produced from an originally plane blank which has a substantially rectangular first part, which in the finished product defines said connecting portion, and a second part, which in the finished product defines said contact portion. A plurality of such blanks is joined into a metallic punching band with an obverse face and a reverse face and comprising a first zone with all the first parts of the blanks, and a second zone with all the second parts of blanks. On at least the obverse face of the first zone is an insulating cover or coating applied before the individual blanks are removed from the punching band, so that the contact elements having a metallic connection portion with an insulating layer are obtained.

15 Claims, 3 Drawing Sheets

METHOD OF PRODUCING CONTACT ELEMENTS FROM BAND MATERIAL AND CONTACT ELEMENTS PRODUCED BY THE METHOD

FIELD OF THE INVENTION

The present invention refers to a method of producing, from band-shaped material, contact elements such as cable shoes and tubular end-sleeves for crimping onto the stripped ends of electrical conductors, and to conductors produced by the method.

BACKGROUND OF THE INVENTION

Cable shoes are understood as contact elements which are provided with a connecting portion, defined by a hollow cylinder, and a contact portion, which consists, the same as the connecting portion, of metal, and which may have many different shapes. A stripped end of a conductor is introduced into the connecting portion, but not into the contact portion, and the connecting portion, which possibly may be provided with an insulating sleeve, is crimped onto said end.

End-sleeves are understood as contact elements in which the stripped end of an electrical conductor is inserted immediately into the contact portion (sleeve portion) and is crimped therein. A connection portion, consisting, in the same way as the contact portion, of uninsulated metal, may be provided for seizing the insulated end part of the conductor by being crimped thereon.

"Aderend-type end-sleeves with a plastic collar" are well known types of end-sleeves where all-metallic contact or sleeve portions have an all-plastic extruded collar portion (e.g. of polypropylen), also called "insertion funnel", attached thereto. When mounting such an end-sleeve on the stripped end of a conductor (generally a multi wire conductor), the conductor is stripped along a length corresponding to the contact portion and through the insertion funnel is introduced into the contact portion. The metallic sleeve portion is then crimped in a crimping device and may receive a desired non-circular cross-sectional profile, such as a trapezoidal one.

The plastic collar loosely surrounds the insulated end part of conductor, but does not firmly seize it because, not being made of metal, it cannot be crimped. For the same reason, the plastic insertion collar occupies more space, so that conductors provided with such end-sleeves cannot be tightly crammed together, as some connector means, in which the end-sleeves shall be stuck, would demand.

Cable shoes and end-sleeves, besides being produced individually, are also produced in bands and removed from the band ("band material") first when (by roll crimping) being crimped onto the conductor. Contact elements in bands are, in respect to production as well as application, generally more advantageous than individually produced contact means, because, among other things, the conductor does not need to be inserted into them only in axial direction, but can be put into their crimp claws—which define the connecting portion in uncrimped condition—also at right angles to the longitudinal direction of the conductor.

Slipping on an insulating sleeve on individually produced cable shoes, as well as mounting the extruded plastic collar on individually produced end-sleeves, demands a separate working operation, as a result, it is therefore rather slow and expensive.

Contact elements in bands have up to now not been available at all with an insulated connection portion. This is more deplorable as the insulation has in individually produced contact elements besides of its primary function, also the important function of being a color code (e.g. red, yellow, green) for indicating the recommended range of application (in terms of conductor cross-section ranges) of the respective contact element.

OBJECTS OF THE INVENTION

It is a primary object of the present invention to provide a method of producing contact elements from band material, which at their connecting portion are provided with an insulation in a selected color, which can be tightly crammed together on a small space, and which firmly grasp the insulated end portion of the respective conductor, and allow for a color coding.

The present invention provides for the first time band material from which in a fully automated process contact elements, inclusive of wire end ferrule end-sleeves, may be obtained which have an insulated, i.e. protected and touch-proof connecting portion which at the same time by its color (e.g. in accordance with the proposed German Standard DIN 46228, part 4, referring to wire end ferrule end-sleeves with extruded collar) can indicate which range of conductor cross-sections the respective contact element is suited for.

Aderend-type end-sleeves according to the present invention thus have the important advantage over end-sleeves with an extruded collar, being that their insulated connecting portion may be crimped onto the insulation of the terminal part of the conductor, so that this latter insulation is prevented from gliding back, and at the same time the total strength of the mechanical connection of the conductor with the contact element, now based on crimpings of both the contact, and the connecting portions, is increased.

The crimped insulated connecting portion also has a smaller over-all diameter than the loose extruded collar, whereby the space requirement is significantly reduced, which is an important advantage when a plurality of conductors terminated by such contact elements has to be connected to tightly packed connectors on a connecting strip or the like.

SUMMARY OF THE INVENTION

The said object and others, which will become apparent hereinafter, are attained by a method of producing contact elements, inclusive of end-sleeves and cable shoes, of the type provided for crimping onto stripped ends of electrical conductors and having a connecting portion and a contact portion, from metallic blanks comprising a substantially rectangular first part from which the connecting portion of the contact elements shall be formed and which is limited by two side edges and an end edge, and a second part from which the contact portion of the connecting element shall be formed and which is terminated by a front edge, said blanks being, with the aid of connecting bridges, joined into a metallic punching band having an obverse face, defining the outer face of the contact elements, and a reverse face, and comprising a first zone which includes all said first parts and has a terminal edge corresponding to all said end edges, and a second zone which includes all said second parts, which method comprises the step of an insulating layer being applied, before the individual blanks are separated from one another, on the first zone of the punching band, at least on the obverse face thereof and so as to cover the entire first part of each blank inclusive of the end edge and of at least one of the side edges.

Said insulating layer may be applied by either of the specific methods which will be declared more in detail below.

DETAILED DESCRIPTION OF PREFERRED EMBODIMENTS

Figure 1:
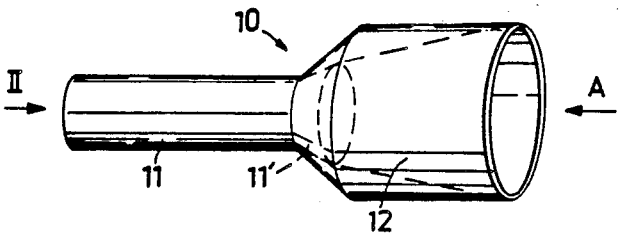
Fig. 1 PRIOR ART
FIG. 1 is a perspective view of a known Aderend-type end-sleeve.
Figure 2:
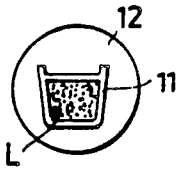
FIG. 2 is a front view in the direction of the arrow II in FIG. 1.

According to FIGS. 1 and 2, a conventional, individually produced wire end ferrule end-sleeve 10 with an extruded plastic collar has a contact portion 11 defined by a hollow metallic cylinder, at one end 11' of which a plastic insertion collar or insertion sprout 12 of insulating material is attached. The conductor 110 (FIG. 2), which at one end is stripped along a length corresponding to the length of the said cylinder, is inserted into the end-sleeve in the sense of arrow A, i.e. in its axial direction, and is thereafter crimped together with the contact portion, e.g. into a trapeziodal cross-sectional shape shown in FIG. 2. The plastic collar 12, the color of which has been selected as a code signal, surrounds loosely the insulation on the non stripped-off end part of the conductor.

According to the present invention, no individual end-sleeves with insulating insertion collars or funnels are produced. Instead, in a manner known per se, punching bands (band material 20 (FIG. 3) or 120 (FIG. 5) are produced of a metal plate of a selected kind and thickness, e.g. 0.5 mm thick brass bands each comprising a plurality of contact means blanks 30, 130. The blanks are planar and are interconnected by connecting bridges 23, 123, and comprise each substantially a first part 31, 131 and a second part 32, 132.

The first parts 31, 131 are essentially rectangular in shape and are at least at the location of attachment to the second part narrower than the second part, e.g. due to a restriction 33" (FIG. 14) or to two such restrictions 33, 133, one on each side (in the latter case, the first and the second parts may have a common axis of symmetry D).

Consequently, the bands 20, 120 comprise in principle a first zone I with all the first parts 31, 131, and a second zone II with all the second parts 32, 132.

Figure 3:
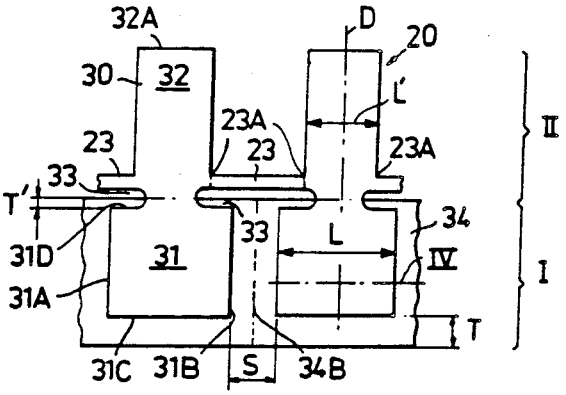
FIG. 3 shows in a plan view a portion of a punching band ("band material") according to the invention in a first embodiment.
Figure 5:
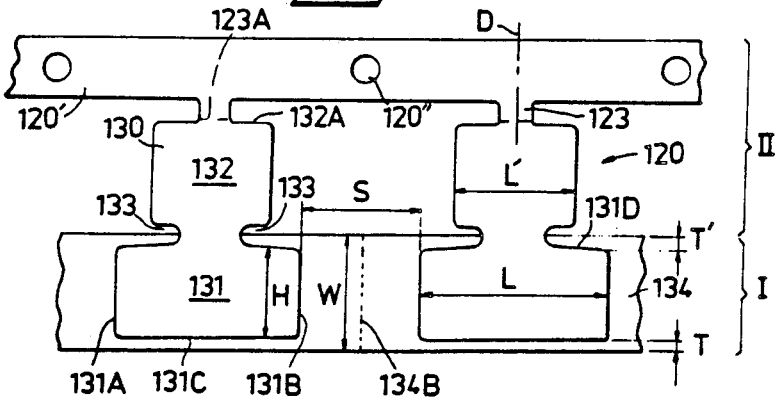
FIG. 5 shows in plan view a part of a punching band ("band material") according to the invention in a second embodiment.

The second parts 32, 132 have, in the case of blanks for end-sleeves, also an essentially rectangular shape (as shown in FIGS. 3 and 5), and are at their free end terminated by a front edge 32A, 132A. The first parts 31, 131 are at their free end terminated by an end edge 31C, 131C and are laterally limited by side edges 31A, 31B, 131A, 131B.

According to FIGS. 3 and 5, the second parts 32,132 are narrower than the first parts not only at the location of attachment, but also generally. The length dimensions L, L' (in horizontal direction in FIGS. 3 and 5) correspond to the expected circumferential length of the future contact and connection portions, preferably with an addition for overlapping, as at B in FIGS. 9 and 12).

The restrictions such as 33, 133 allow the first and second parts to be rolled or crimped to different cross-sectional dimensions and/or profiles, or (with cable shoes, FIGS. 13 and 14) only the first part to be rolled and crimped, the second part remaining plane.

An edge or carrier zone 120' (FIG. 5) of the band 120 is provided with manipulating openings 120" for feeding the band forward in the crimping device.

Figure 13:
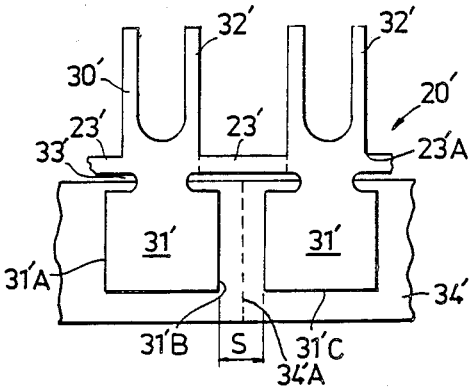
FIG. 13 shows in plan view a part of a band ("band material") according to the invention in a third embodiment (for producing cable shoes)
Figure 14:
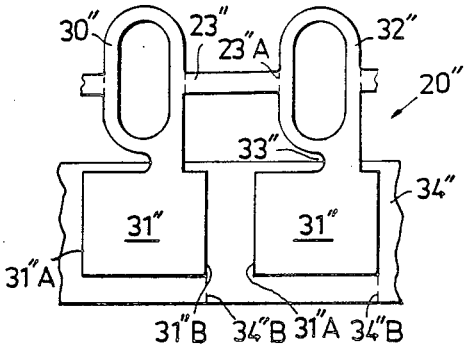
FIG. 14 shows in a plan view a part of a band ("band material") according to the invention in a fourth embodiment (also for producing cable shoes)

It will be understood that the connecting bridges also may be located elsewhere than what is shown in FIGS. 3 and 13, e.g. in half the length of the second part (as shown in FIG. 14), or, as shown in FIG. 5, between the front edge 132A and said zone 120' (in or outside the region of the axis of symmetry D).

On one side or face of the band 20, 120, viz. this one, which shall define the obverse face of the finished contact element (the reverse face in FIGS. 3 and 5), is a strip of a suitable insulating material of selected thickness and color, e.g. a 0.05 to 0.1 mm thick polyester foil commercialized under the trademark "Mylar", applied (e.g. bonded, welded).

The spacement of the individual blanks one from another in the punching bands 20, 120 is preferably selected so, (by appropriately dimensioning the connecting bridges 23, or positioning the connecting bridges 123) that between each two neighbouring first parts 31, 131 of the blanks 30, 130 a space S of selected length, flanked by the side edges 31A, 31B, 131A, 131B of the said first parts, remains free of metallic material, and is bridged only by the insulating strip 34, 134.

Figure 4:
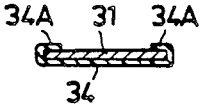
FIG. 4 is a cross-section along the plane IV—IV in FIG. 3, at a later work phase.
Figure 15:
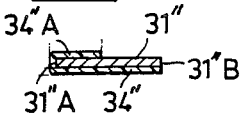
FIG. 15 is a cross-section along the plane XV—XV in FIG. 14, FIGS. 16 and 17 show two punches for crimping contact elements according to the invention.

The purpose of this arrangement is to enable for the insulating strip 34, 134, after having been cut up, as will be explained below, to be bent around at least one of said side edges 31A, 31B, 131A, 131B, as shown in FIG. 15 at 34"A (bending around one side edge), and in FIGS. 4 and 7 at 34A (bending around two side edges) in order to insulate even the respective side edge.

The insulating strip 34, 134 has a width W (FIG. 5) which is somewhat larger than the height H of the first parts 31, 131, but smaller than double this height. The strip is so located, that it with a distance T reaches over the end edges 31C, 131C in order to achieve a safe insulation of this edge in the finished contact element, and possibly also with a distance T' reaches over the opposite edge 31D, 131D.

The punching band 20, 120, as well as the insulating strip 34, 134, are each produced in a per se known manner. Alternative methods of applying an insulation to the first portion of a contact element according to the present invention will be described below, e.g. in connection with FIGS. 18 and 19.

Figure 6:
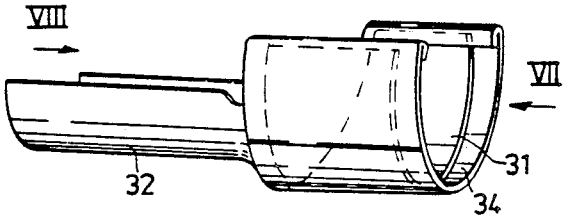
FIG. 6 is a perspective view, similar to that of FIG. 1, of a pre-bent blank according to the invention in a first embodiment.

Preferably, the blanks 30, 130 may be before crimping partially pre-bent, i.e. bent into the shape shown in FIG. 6.

In principle it may be chosen, if the blanks, when provided with the insulation on their first portions, or after having been pre-bent, be separated and further treated as any other individual contact elements, or if they, preferably, will be delivered as band material in more or less long bands and separated first in connection with crimping onto the end of a conductor.

Upon separation, the connecting bridges 23, 123 are severed either on two locations (at 23A in the embodiment of FIG. 3) and disposed off, or on one location (at 123A in the embodiment of FIG. 5), so that they remain connected with the edge or carrier zone 120' and are disposed off therewith.

Separation scores may be preferably provided at the respective locations 23A, 123A when the punching band is produced.

As already mentioned, also the insulating strip 34, 134 is separated at a selected location 34B, 134, 34"B (FIG. 15) between two adjacent blanks 30, 130 and is then bent around one of the adjacent side edges (31"A, FIG. 15) or, when the location of separation lies in the central region of the space S, around both such edges 31A, 31B, 131A, 131B, and is then preferably bonded etc. to the reverse face of the respective first part.

An insulated conductor 110 has an insulating sheath or cover M (FIG. 9), which has been stripped at the end. A crimping device (such as a crimping tool or a crimping apparatus) has suitably shaped punches for the first parts 31, 131 and, in the case end-sleeves, also for the second parts. The end part of the conductor 110 may be from any arbitrary direction, i.e. not only in the longitudinal direction of the conductor, but also at right angles thereto, inserted into the blank, possibly a pre-bent one, placed in the punch or punches. When the crimping device is then operated, the first portion 31, 131 is crimped around the stripped end (in cable shoes) or (in end-sleeves) around the adjacent non-stripped end part of the conductor 110, generally into a cylindric shape (FIG. 9), and preferably with a certain overlapping B of the side edge regions.

Figure 8:
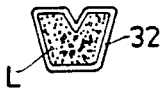
FIG. 8 shows in a front view in the direction of the arrow VIII in FIG. 6 an end-sleeve made of the blank of FIGS. 6 and 7 after crimping.

In the case of end-sleeves are at the same time the second parts 32, 132 in a suitable punch crimped around the stripped end of the conductor into a desired cross-sectional shape (FIG. 8). The part (distance T, FIGS. 3 and 5) of the insulating strip 34, 134, which reaches over the end edge 31C, 131C assures uninterrupted connection between the insulation of the conductor and that of the contact element.

If the insulation strip 34, 134 has been bent only around one side edge 31"A (FIG. 15), then this side edge has to lie uppermost after crimping, so as to cover the non insulated other side edge 32"B.

Figure 7:
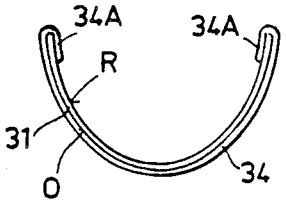
FIG. 7 shows the blank of FIG. 6 in a rear view in the direction of the arrow VII in FIG. 6.
Figure 9:
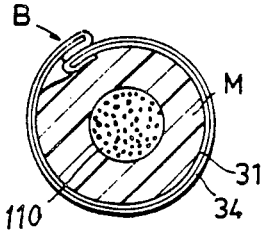
FIG. 9 is the same rear view as in FIG. 7 after the blank has been crimped onto a conductor.

In FIGS. 6 and 7 is shown a blank 30 taken from a punching band 20 according to FIG. 3 after pre-forming, and in FIGS. 8 and 9 are shown its first and second parts respectively after the final crimping.

Figure 11:
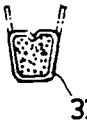
FIG. 11 is a front view of the end-sleeve of FIG. 10 in the direction of the arrow XI in FIG. 10.
Figure 10:
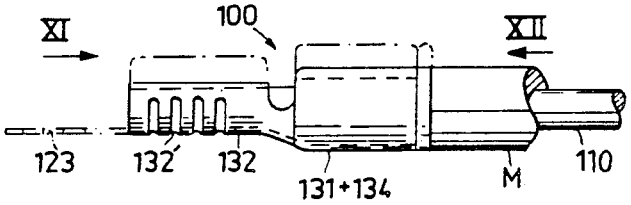
FIG. 10 is a side view of an end-sleeve according to the invention in a second embodiment.
Figure 12:
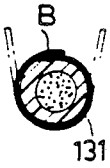
FIG. 12 is a rear view of the end-sleeve of FIG. 10 in the direction of the arrow XII in FIG. 10.

In FIGS. 10 to 12 is shown an end-sleeve 100 obtained from a blank 130 according to FIG. 5 after crimping, i.e. after having been attached to a conductor 110. By mixed lines is shown the outline of the pre-bent blank (before separation from the connecting bridge 123). In the second part 132, shaped into a connecting portion, is a plurality of indentations 132' provided which increase the strength of the mechanical attachment and which have been produced e.g. at the pre-shaping operation leading to the stage shown in FIG. 6. Alternatively, such indentations may be also produced immediately before the crimping operation (e.g. in a second punch).

An end-sleeve according to the present invention consists consequently of a metallic body which has been obtained by rolling up, in a per se known manner, two different, but contiguous parts of an originally flat blank 130, the connecting portion 131 of the end-sleeve, obtained from the first part 131 of the punching band, and intended to be crimped around an insulated part of the conductor, being at least on its outer face provided with an insulating cover.

In contrast to conventional end-sleeves with an insulating collar 12 (FIG. 1), the end-sleeve according to the present invention has, as already mentioned, the advantages of a more rational production, of a firmer mechanical attachment to the insulating cover of the conductor, and of a smaller over-all diameter. In contrast to conventional end-sleeves made of band material, the end-sleeve according to the present invention has the advantage of an insulating collar in any arbitrary color having the function of a code.

The punching band 20' of FIG. 13 differs from the punching band 20 of FIG. 3 only in that, that the blanks 30', with unchanged first parts 31', have second parts 32' which instead of end-sleeve contact portions define fork-shaped contact portions which are not to be further deformed, so that the end product is a cable shoe. The process differs from the one which was described in connection with FIG. 3 only in that, the stripped end of the conductor is now not inserted into the second, but in the first portion 31' of the blank. The insulating strip 34' with separation locations 34'A, and the connecting bridges 23' with separation locations 23'A correspond to the embodiment of FIG. 3.

There are also cable shoes in which the contact portion is not plane, but e.g. rolled up. It will be understood that also such cable shoes may be produced according to the invention, viz. in the same way as end-sleeves, but without inserting the conductor into the second portion.

The punching band 20" of FIGS. 14 and 15 also comprises blanks for cable shoes. The connecting bridges 23" are located approximately in half the height of the second parts 32", the first parts 31" are separated from the second parts by a single restriction 33" (so that the blank 30" is no longer axially symmetrical), and the insulation strip 34" is severed at 34"B, i.e. closely adjacent the side edge 31"B, and is bent around only one side edge 31"A of an adjacent blank.

Figure 16:
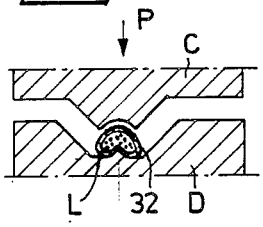

In FIG. 16 is shown how a second part 32 according to FIG. 6 is deformed in a die of a crimping device into a contact portion e.g. according to FIG. 8 or 11 (depending on the shape of the die). The press punch or die has two halves C and D which may be approached one to another in the sense of the arrow P.

Figure 17:
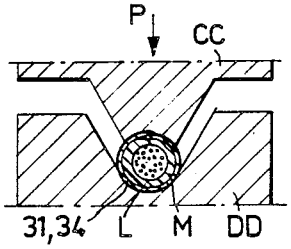

In FIG. 17 is shown how a first part 31, 34 according to FIG. 6 is deformed into a cylindrical, insulated connecting portion e.g. according to FIG. 9 in the die of a crimping device which comprises two halves CC, DD which may be approached one to another in the sense of the arrow P.

Figure 18:
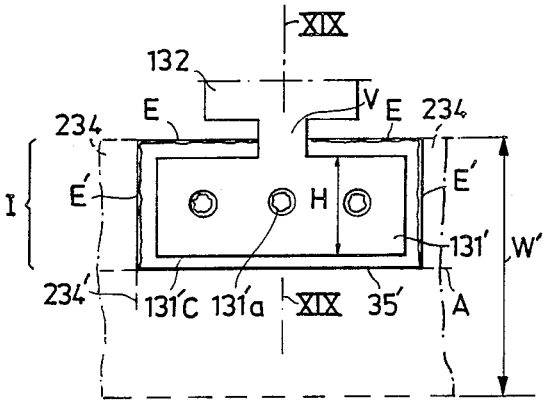
FIGS. 18 and 19 show in plan view and in a cross-section along the plane XIX—XIX in FIG. 18 an alternative embodiment of the insulation.
Figure 19:
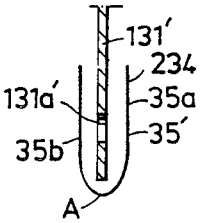

In FIGS. 18 and 19 is shown an alternative method of applying an insulation to the first parts of the blanks. On each first part such as 131' is a bag 35' of insulating material slipped on and affixed by bonding or welding along at least one of its edges, e.g. edge E. From the study of FIG. 18 it will be understood that one may start from a rectangular piece of the respective insulating material, somewhat larger than double the area of the first part 131' which has to be covered that this piece is folded along a line A around the end edge 131'C of the first part 131', and bonded or welded along its remaining edges (with the exception of the zone V at the connecting bridge). Also some other edge, e.g. one of the side edges E', may be used for said bending.

Preferably, however, a strip of insulating material 234 is applied on an arbitrary face (obverse or reverse) of the zone I of the punching band, which comprises all the first parts, but in contrast to e.g. FIG. 3, the strip 234 has now a width W' which corresponds to somewhat more than double the height H of the respective first part 131'. This strip is bent around the end edge 131'C of the first part 131' (or more correctly, around the end edge of the zone I of the punching band) and is along its edge E (except in the area V) bonded or welded. By cuts at 234' and preferably, by bonding or welding along the edges E', the individual bags, analogous to the earlier described ones, are then produced.

For a still better attachment of the insulating bag, the first part 131' may be provided with at least one opening 131'*a* through which the two walls 35*a*, 35*b* of the bag 35' also are bonded or welded together.

A third alternative for applying an insulation on the first parts of a contact element according to the present invention is to apply a layer of an insulating varnish on at least one face (this, which shall define the outer face of the finished contact element) of the said zone I of the punching band by spraying or, preferably, by immersing this zone into a bath of such varnish.

A fourth alternative consists in subjecting at least said face of said zone to a powder baking process.

We claim:

1. A flat metal blank for producing a finished contact element with a contact portion and an insulated, barrel-shaped connecting portion, said blank comprising:
   a substantially rectangular first part; and
   a second part separated from the first part by at least one restriction;
   wherein the first part, which is rolled into the connecting portion of the finished contact element, includes an obverse face corresponding to an outer face of the finished contact element, and a reverse face, said first part being limited by two side edges and an end edge, the first part being on its obverse face covered by an insulating strip which at least at one of said side edges is folded back to the reverse face; and
   wherein the second part corresponds to the contact portion in the finished contact element.

2. The blank of claim 1, wherein the insulating strip is folded back to the reverse face at both side edges.

3. The blank of claim 1, wherein the insulating strip is bonded to the reverse face.

4. The blank of claim 1, wherein the first part is separated from the second part by a single restriction and the blank is axially non-symmetrical.

5. The blank of claim 1, wherein the insulating strip is in a selected code color.

6. A flat metal blank for producing a finished contact element with a contact portion and an insulated, barrel-shaped connecting portion, said blank comprising:
   a substantially rectangular first part; and
   a second part separated from the first part by at least one restriction;
   wherein the first part, which is rolled into the connecting portion of the finished contact element, includes an obverse face corresponding to an outer face of the finished contact element, and a reverse face, said first part being limited by two side edges and an end edge;
   wherein the second part corresponds to the contact portion in the finished contact element; and
   wherein both said obverse and reverse faces of the first part are covered by parts of a rectangular piece of insulating material which has more than double the area of the first part and which has been folded along one said edge of the first part, thus two insulating walls are obtained that are bonded together along remaining edges thereof, whereby the first part is contained in a bag made of said insulating material.

7. The blank of claim 6, wherein the insulating material is in a selected code color.

8. The blank of claim 6, wherein at least one opening is provided in the first part, and the said two insulating walls are bonded together in this opening.

9. A metallic punching band comprising:
   a plurality of interconnected blanks, each for producing a finished contact element with a contact portion and an insulated, barrel-shaped connecting portion, each of said blanks including:
      a substantially rectangular first part; and
      a second part separated from the first part by at least one restriction;
      wherein the first part, which is rolled into the connecting portion of the finished contacting portion, includes an obverse face corresponding to an outer face of the finished contact element, and a reverse face, said first part being limited by two side edges and an end edge, said first part being on its obverse face covered by an insulating strip which is at least at one of said side edges folded back to the reverse face; and
      wherein the second part corresponds to the contact portion in the finished contact element;
   a first zone including the first parts of said plurality of blanks and having a terminal edge comprising the end edges of said plurality of blanks, said first zone having an obverse face comprising the obverse faces of the first parts and being covered by the insulating strip of material with spacing between adjacent said side edges of neighboring first parts being sufficiently large to allow folding of a part of the insulating strip back around at least one of said side edges of each first parts, and a second zone including all said second parts, the plurality of blanks being interconnected only in the second zone.

10. The punching band of claim 9, wherein said contact elements are to be crimped onto stripped ends of electrical conductors, and said second parts are designed to embody, after crimping, contact portions of wire end ferrule end-sleeves, and said first parts are designed to embody, after crimping, insulated connecting portions of these end-sleeves.

11. The punching band of claim 9, wherein said contact elements are to be crimped onto stripped ends of electrical conductors, and said second parts are designed to embody contact portions of cable shoes, and said first parts are designed to embody, after crimping, insulated connecting portions of the cable shoes.

12. The band of claim 9, wherein the strip of insulating material is in a selected code color.

13. A metallic punching band comprising:

a plurality of interconnected, flat metal blanks, each for producing a finished contact element with a contact portion and an insulated, barrel-shaped connecting portion, each of said blanks including:

a substantially rectangular first part; and a second part separated from said first part by at least one restriction;

wherein the first part, which is rolled into the connecting portion of the finished contact element, includes an obverse face corresponding to an outer face of the finished contact element, and a reverse face, said first part being limited by two side edges and an end edge, both said obverse and reverse faces being covered by parts of a rectangular piece of insulating material that has more than double the area of the first part and which has been folded along one said edge of the first part, thus two insulating walls are obtained that are bonded together along edges thereof, whereby the first part is contained in a bag of insulating material and wherein the second part corresponds to the contact portion in the finished contact element;

a first zone including all said first parts and having a terminal edge comprising the end edges of the plurality of blanks, said first zone having an obverse and a reverse face comprising the obverse and reverse faces of the first parts, respectively, both first zone faces being covered by an insulating layer embodied by two insulating walls of a strip of insulating material having an unfolded width greater than twice the height of the first zone, said insulating walls being folded along said terminal edges, with spacings between adjacent said side edges of neighboring said first parts being sufficiently large to allow, after the insulating strip has been cut in the spacings, bonding of the two insulating walls together along side edges thereof to define the bag; and a second zone including all said second parts of said plurality of blanks, the blanks being interconnected only in the second zone.

14. The band of claim 13, wherein the strip of insulating material is in a selected code color.

15. The punching band of claim 13, wherein said contact elements are to be crimped onto stripped ends of electrical conductors, and said second parts are designed to embody, after crimping, contact portions of wire end ferrule end sleeves, and said first parts are designed to embody, after crimping, insulated connecting portions of these end-sleeves.

* * * * *